United States Patent [19]

Byrd, Jr.

[11] 4,012,877

[45] Mar. 22, 1977

[54] PREFABRICATED INSULATING STRUCTURE FOR INSULATING A CORNER IN A FURNACE

[75] Inventor: Carlisle O. Byrd, Jr., Houston, Tex.

[73] Assignee: J. T. Thorpe Company

[22] Filed: Apr. 2, 1976

[21] Appl. No.: 672,993

Related U.S. Application Data

[63] Continuation-in-part of Ser. Nos. 475,439, June 3, 1974, Pat. No. 3,952,470, and Ser. No. 603,391, Aug. 11, 1975.

[52] U.S. Cl. ..... 52/275; 52/267; 52/285; 52/511

[51] Int. Cl.[2] ..... E04B 1/80

[58] Field of Search ..... 428/99, 126; 52/277, 52/278, 276, 275, 267, 269, 506, 511, 404, 407

[56] References Cited

UNITED STATES PATENTS

| | | | |
|---|---|---|---|
| 868,411 | 10/1907 | Cilek | 52/275 X |
| 3,553,920 | 1/1971 | Cole, Jr. | 52/506 |
| 3,581,450 | 6/1971 | Patry | 52/403 |
| 3,605,370 | 9/1971 | Prible | 52/622 |
| 3,819,468 | 6/1974 | Sauder et al. | 52/270 X |
| 3,854,262 | 12/1974 | Brady | 52/404 |
| 3,952,470 | 4/1976 | Byrd, Jr. | 52/509 |

*Primary Examiner*—Alfred C. Perham
*Attorney, Agent, or Firm*—Pravel, Wilson & Gambrell

[57] ABSTRACT

A prefabricated insulating structure is formed from a ceramic fiber blanket, folded into plural folds, for insulating a corner formed by two walls within a furnace. The folded blanket is mounted in a curved configuration to a single attachment mounting such that each of the two ends of the curved folded blanket is adjacent one of the walls at the corner. The folded blanket is mounted to the attachment mounting by two support members, each of the support members being mounted in a fold adjacent one of the ends of the folded blanket.

12 Claims, 3 Drawing Figures

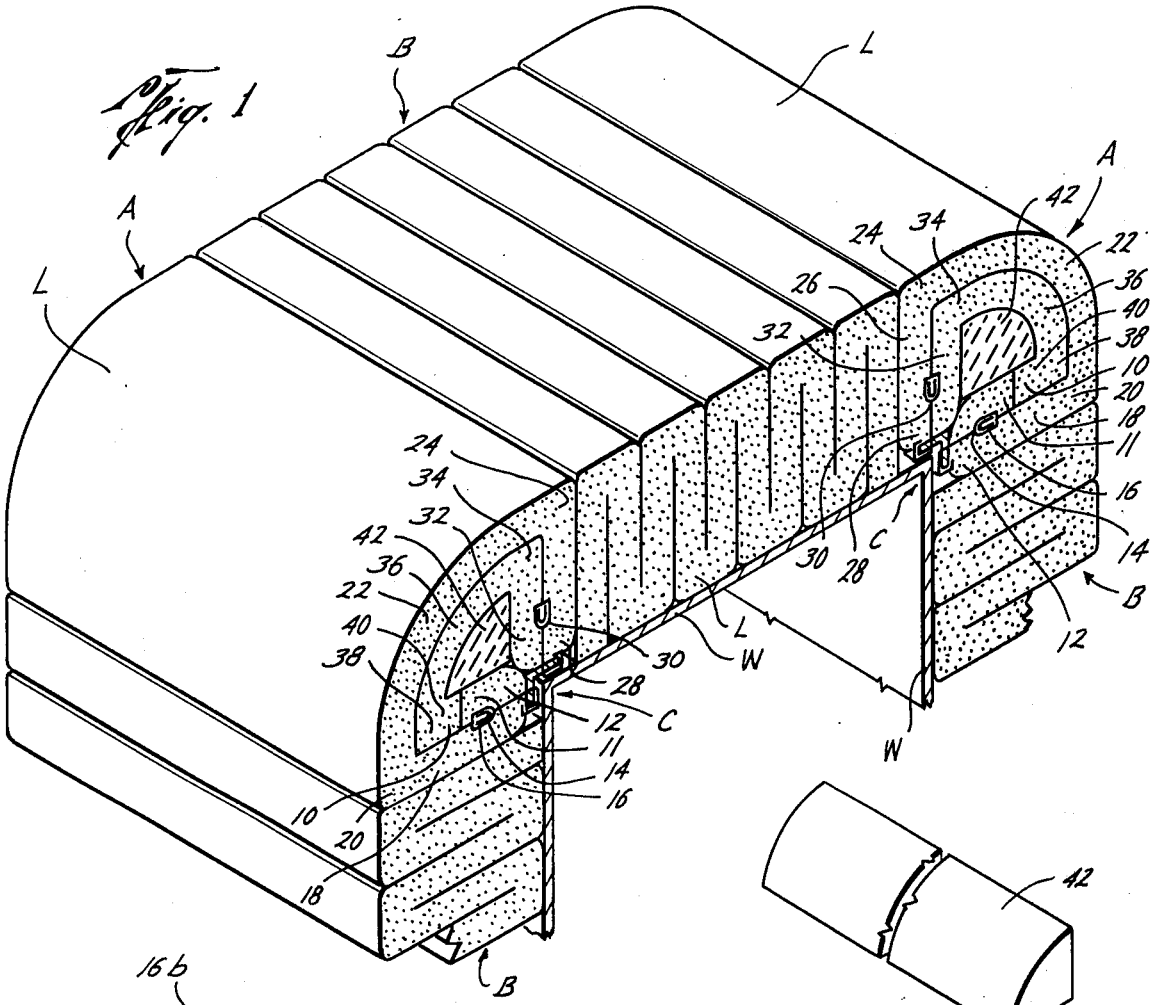
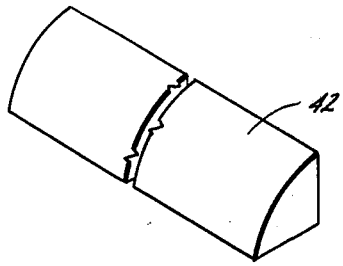
Fig. 2
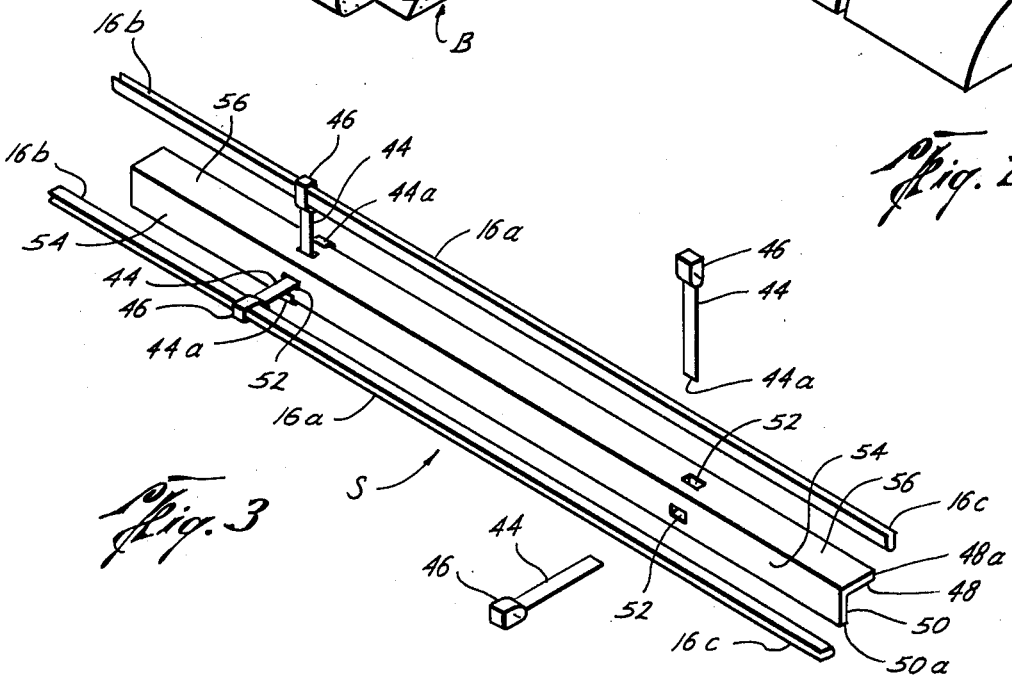
Fig. 3

PREFABRICATED INSULATING STRUCTURE FOR INSULATING A CORNER IN A FURNACE

CROSS-REFERENCE TO RELATED APPLICATIONS

The present invention is a continuation-in-part of U.S. Pat. application Ser. No. 475,439, filed June 3, 1974 now U.S. Pat. No. 3,952,470 and of United States patent application Ser. No. 603,391, filed Aug. 11, 1975.

BACKGROUND OF THE INVENTION

1. Field of the Invention

The present invention relates to insulating structures for insulating corners between two walls in a furnace or other high temperature equipment.

2. Description of the Prior Art

It has been known to use refractory bricks or structure to line furnaces, as exemplified in United States Pat. Nos. 741,629; 1,701,480; 1,813,790; 2,368,265; 3,302,356; and 3,630,503.

Ceramic fibers or blankets made from refractory fibrous materials such as chromia-alumina-silica, alumina-silica compositions and zirconia compositions have become desirable as furnace insulation because of their ability to withstand high temperatures. In the past, efforts have been made to attach the fiber or blanket material to the furnace wall using stainless steel attachment structure, but this attachment structure has often been unable to withstand the high temperatures present at the insulation surface and melted or otherwise failed. Further, the ceramic fibers tended to vitrify and shrink during long exposure to high temperatures.

Also, other prior art efforts to insulate furnace walls and the corners between such walls, such as in United States Pat. Nos. 2,341,777; 3,147,832; 3,523,395; 3,687,093; 3,738,217; 3,742,670 and 3,771,467, were made to impale or spear the ceramic blanket on a pin or stud mounted with the furnace wall, with a washer mounted at the end of the stud to hold the blanket in place. However, the blanket tended to sag and tear away from the furnace wall with this structure. Also, the studs served as conduits for heat through the blanket to the furnace wall.

Other similar apparatus, such as in U.S. Pat. No. 3,832,815 were in the form of modules formed from blankets or strips of ceramic fiber material. However, the strips of ceramic material were punctured or pierced by connecting pins when mounted in modules, and the fiber blankets would thus tend to fall away from the pin in the area of the holes where the blankets were pierced by the pin.

Other panels, such as in U.S. Pat. No. 3,605,370 used ceramic wool blankets mounted over refractory blocks, held in place with the blocks by alloy rods in folds of the blankets in spaces between adjacent blocks. With this construction, the blankets were laid flat over the blocks and susceptible to shrinkage. Further, a direct path to the support wires was present between adjacent folds of the blanket for passage of heat and corrosive elements of the furnace atmosphere to the support wires.

SUMMARY OF THE INVENTION

Briefly, the present invention provides a new and improved insulating structure for insulating a corner between two walls in a furnace or other high temperature equipment. The insulating structure includes an insulating blanket of fiber insulating material which is folded into a plurality of folds of adjacent layers and an attachment mounting for attaching the insulating blanket to the furnace walls adjacent the corner formed thereby.

The folded blanket includes a curved inner surface portion exposed to the interior of the furnace, a first side surface portion which extends from the curved inner surface portion to a fold formed in the blanket adjacent the end portion thereof, the fold being adjacent a first one of the two furnace walls at the corner when the insulating structure is installed. A second side surface portion extends from an opposite end of the curved inner surface portion from the first side surface portion to a fold formed in the blanket adjacent the other end portion of the folded blanket, the fold being adjacent the other wall of the furnace.

A first support member is mounted in the fold formed in the blanket adjacent the first of the furnace walls, and a second support member is mounted in the fold formed adjacent the second of the furnace walls. The support members, in turn, are mounted by suspension arms with the attachment mounting so that the blanket may be mounted about the corner formed by the furnace walls for completely insulating the furnace walls at the corner.

BRIEF DESCRIPTION OF THE DRAWINGS

FIG. 1 is an isometric view, taken partly in cross-section, of the insulating structure of the present invention in position at a corner between two furnace walls;

FIG. 2 is a shortened isometric view of an insulating core for the structure of FIG. 1; and FIG. 3 is a partially exploded isometric view of the supports and attachment mounting structure for the insulating structure of the present invention.

DESCRIPTION OF THE PREFERRED EMBODIMENT

In the drawings, the letter A designates generally the insulating structure of the present invention for insulating a corner C between each of the adjacent walls W of a furnace or other high temperature equipment such as soaking pits, annealing furnaces, stress relieving units and the like. Typically, the insulating structure A is mounted between prefabricated insulating blocks B which are mounted along each of the walls W to insulate such walls. The insulating structure A is adapted to insulate the non-planar surface formed at the corner C where the walls W intersect.

The prefabricated insulating blocks B are preformed from ceramic fiber blankets L folded into a plurality of folds and are attached to the furnace wall W by suitable attachment mountings. Further details concerning the structure of insulating block B and the attachment mountings therefor are set forth in applicant's co-pending U.S. Pat. application Ser. No. 603,391, filed Aug. 11, 1975, and allowed co-pending U.S. Pat. application Ser. No. 475,439, filed June 3, 1974, now U.S. Pat. No. 3,952,470, each of which is assigned to the assignee of the present invention.

The insulating structure A is preformed from an insulating blanket of ceramic fiber, such as a blanket L, which is folded into a plurality of folds of adjacent layers, as will be set forth, and has supports S (FIG. 3) mounted therein for mounting the folded blanket L to an attachment mounting M in a curved configuration.

The attachment mounting M mounts the prefabricated insulating structure A about the corner C formed by the non-planar intersection of two adjacent walls W for insulating the furnace at the corner C.

Considering the blanket L in more detail, such blanket may be formed from a suitable commercially available ceramic fiber sheet, such as the type known as "Cerablanket", sold by the Johns-Manville Company, containing alumina-silica fibers or other suitable commercially available refractory fibers. It should be understood that the particular component materials of the ceramic fiber sheet used in the blanket L are selected based upon the range of temperatures in the high temperature equipment in which the structure A is to be installed.

In the insulating structure A, two structures A insulate outwardly exposed furnace surfaces adjacent corners C formed by intersecting walls W (FIG. 1). Each structure A includes a blanket L formed from fibers of the type set forth above. The blanket L has ends 10 and 11 and is folded into a 90° arcuate configuration, as shown, of a plurality of adjacent layers. The blanket L extends as a layer from the end 11 towards the corner C to a U-shaped end portion 12 forming a fold 14 receiving a support beam 16 of the support S therein. The blanket L extends outwardly from the fold 14 along a first side surface layer 18 to a corner 20 at the interior or thermal surface, or "hot face" of the furnace.

The blanket L extends from the corner 20 along a curved inner surface portion or layer 22 exposed to interior conditions of the furnace to a corner 24. The blanket L extends along a side surface portion or layer 26 to a U-shaped inner portion 28 adjacent a fold 39 and from the fold 30 along an inner side surface portion or layer 32 to an inner corner 34 adjacent the corner 24. An inner insulating fold or layer 36 extends from the corner 34 inside the inner surface portion 22 to a corner 38 adjacent the corner 20, and an inner side surface layer portion 40 of the blanket L extends from the corner 38 to the end 10.

It should be noted that the folded blanket L placed in the curved configuration set forth above completely encloses the support beams 16 so that there is no path for the passage of heat and corrosive elements of the furnace atmosphere thereto. It should also be noted that multiple folds in the blanket L may be made, if desired. Further, the inner fold 36 need not be included where it is not necessary.

The inner insulating fold 36 and inner side surfaces 32 and 40 of the blanket L form a wedge-shaped pocket or enclosure which may be filled with an insulating core 42 (FIGS. 1 and 2) of suitable insulating material, such as solid ceramic material. The insulating core 42 may be of a material having a suitable temperature rating dependent upon the desired insulating capacity of the insulating structure A. The insulating core 42 further provides structural strength to the blanket L.

Alternatively, instead of a solid ceramic core 42, a large mass of bulk ceramic fibers, or other lower temperature insulating refractory material of lower cost, may be placed in the pocket to serve as a core. This bulk material may be contained temporarily in a plastic or fiber container which will burn and be consumed when the insulating structure A is exposed to the heat of the furnace.

In the layers of the blanket L, the fibers of the material normally extend longitudinally within the layer. However, a stronger and more compact insulating structure A may be formed by "needling" adjacent layers of the blanket L together.

In the needling process, a needle loom, such as a needle felting machine such as a "Fiberlocker" sold by the James Hunter Machine Company of North Adams, Mass., is used to change the orientation of a portion of the normal longitudinally extending fibers so that some fibers in adjacent layers are transversely disposed to the remainder of the fibers and extend into adjacent layers to bind the layers together into a more compact insulating structure. In this manner, the perpendicular fibers bind the adjacent lamina or layes of the blanket L together, compacting and strengthening the blanket L. Further, the needling process binds the adjacent fibers together into a tougher, more homogeneous mass. Needle felting processes for ceramic fiber blankets are further described in Applicant's co-pending United States patent application Ser. No. 603,391, which is incorporated herein by reference. When bulk ceramic fibers are used to form the insulating core 42 of the folded blanket L, the mass of bulk ceramic fibers may, if desired, be needled to more uniformly distribute, reorient and tie together the fibers.

It should also be noted that the use of bulk fibers substantially lowers the cost of the insulating structure A without impairing the ability of the insulating structure A to withstand high temperatures.

The support beams 16 (FIG. 3) are formed from folded bars of a high temperature-resistant metal or alloy or other suitable material, although other shapes of support beams and materials may be used, as set forth in Applicant's co-pending United States patent application Ser. No. 475,439, which is incorporated herein by reference. The support beam 16 extends outwardly from a center portion **16*a* to ends 16*b* and 16*c* over a substantial portion of the lateral length of the folds 14 and 30 in the blanket L. The ends 16*b* and 16*c* preferably do not extend to the side ends of the folds 14 and 30** of the blanket L.

Each support beam is mounted with one or more suspension arms 44 by inserting the support beam 16 through a loop 46 formed at the lower end thereof. Suspension arm 44 is described further in United States patent application Ser. No. 603,391, which is incorporated herein by reference.

If desired, shorter support beams may be used and more than one mounted end to end in the folds 14 and 30 over the lateral extend of the folds instead of using a single support beam 44. Each of these shorter support beams may be mounted at a center portion thereof to a suspension arm 44 in the manner set forth above.

Suitable openings are formed in the two end portions 12 and 28 of the folded blanket L adjacent the folds 14 and 30, respectively, so that the suspension arms 46 may extend through the blanket L toward the walls W.

The suspension arms 44 attach the folded blanket L to an attachment mounting M. For an outwardly exposed corner C, the attachment mounting M is preferably in the form of an angle iron member of a suitable material. For other shapes of corners, appropriately shaped attachment mountings with members coplanar with the intersecting walls W may be used. The attachment mounting M is welded or otherwise mounted to the walls W adjacent the corners C along inner surfaces 48 and 50. A suitable number of openings or apertures 52 are formed along the length of the attachment mounting M for receiving the suspension arms 44.

Mounting lugs 44*a* formed at the ends of suspension arms 44 extend opposite the loops 46 through the blanket L and through the openings 52 in attachment mounting M. The mounting lugs 44*a* are then folded downwardly along the surfaces 48 and 50 toward outer edges 48*a* and 50*a*, respectively, of attachment mounting M and therefrom along surfaces 54 and 56. Folding the ends 44*a* about the attachment mounting M in this manner protects the hands of installers against points or sharp surfaces and further strengthens the connection of the supports S to the attachment mounting M.

It should be noted that other shapes of suspension arms and mounting lugs than those set forth may be used, for example of the types set forth in Applicant's co-pending U.S. patent applications Ser. Nos. 475,439 and 603,391.

The foregoing embodiment has been set forth for an outwardly exposed, 270°, corner C. It should be understood, however, that the present invention is also suitable for insulating various other shapes and configurations of corners of furnaces and other high temperature equipment. For example, for a 90° corner formed between intesecting adjacent walls, the attachment mounting M could be reversed in position from that of FIG. 3 and used to attach the structure A to such a corner.

Although the present invention is described in the preferred embodiment as insulating a furnace or forming a furnace wall, it should be understood that the apparatus of the present invention is also suitable to insulate or form cryogenic, or low temperature equipment, as well.

The foregoing disclosure and description of the invention are illustrative and explanatory thereof, and various changes in the size, shape, and materials as well as in the details of the illustrated construction may be made without departing from the spirit of the invention.

I claim:

1. An insulating structure for insulating a corner between two walls in a furnace, comprising:

a. a folded insulating blanket of fiber insulating material, said folded blanket including:

1. a curved inner surface portion exposed to the interior of the furnace;
2. a first side surface portion extending from said curved inner surface portion to a fold formed in said blanket for placement adjacent a first one of the two furnace walls at the corner;
3. a second side surface portion extending from an opposite end of said curved inner surface portion from said first side surface portion to a fold formed in said blanket for placement adjacent the second of two furnace walls at the corner; and b. means for attaching said insulating blanket to the furnace walls at the corner.

2. The insulating structure of claim 1, wherein:

a portion of said fibers in said layers of said blanket adjacent said folds being transversely disposed to the remainder of said fibers and extending into other adjacent layers to bind the layers together into an insulating structure.

3. The structure of claim 1, wherein said means for attaching comprises:

a. a support member mounted in said fold formed adjacent the first one of the two furnace walls;

b. a suspension arm having said support member mounted therewith, said suspension arm having mounting means therewith extending through said insulating blanket; and c. a mounting member receiving said mounting means of said suspension arm, said mounting member further being adapted for attachment to the first one of the two furnace walls.

4. The structure of claim 3, wherein said means for attaching further comprises:

a. a second support member mounted in said fold formed adjacent the second of the two furnace walls; and b. a second suspension arm having said second support member mounted therewith, said second suspension arm having mounting means therewith extending through said insulating blanket and mounted with said mounting member.

5. The structure of claim 4, wherein said mounting member comprises:

a mounting member having a first side member thereof formed at an angle to a second side member conforming to the angle of intersection of the furnace walls at the corner being insulated, said mounting member receiving said mounting means of said first suspension arm in said first side member and receiving said mounting means of said second attachment arm in said second side member.

6. The structure of claim 5, wherein:

the two furnace walls form an outwardly exposed corner and said first side member is attached to the first wall and said second side member is attached to the second wall whereby said insulating structure is mounted about the corner for insulating the corner from the interior of the furnace.

7. The insulating structure of claim 1, wherein said folded blanket further comprises:

inner side surface portions mounted inside said side surface portions extending inwardly from each of said folds formed in said surface portions.

8. The insulating structure of claim 1, wherein said folded blanket further comprises:

an inner insulating fold extending along the interior surface of said curved inner surface portion opposite said thermal surface.

9. The insulating structure of claim 1, wherein an enclosure is formed adjacent said thermal surface of said inner wall member portion and further including:

an insulating core member mounted within said enclosure.

10. The insulating structure of claim 9, wherein:

said insulating core member substantially fills the enclosure formed by said folded insulating blanket.

11. The insulating structure of claim 9, wherein said insulating core member comprises:

a core member of insulating fibers having a portion of said fibers transversely disposed to the remainder of said fibers and extending into said inner wall portions of said blanket to mount said core member with said blanket.

12. The insulating structure of claim 11, wherein said insulating core material comprises:

a core of solid insulating material.

* * * * *

UNITED STATES PATENT AND TRADEMARK OFFICE

CERTIFICATE OF CORRECTION

PATENT NO. : 4,012,877

DATED : March 22, 1977

INVENTOR(S) : Carlisle O. Byrd, Jr.

It is certified that error appears in the above-identified patent and that said Letters Patent are hereby corrected as shown below:

Column 1, line 22, following "3,302,356" should be --3,362,689--.

Column 4, line 12, "layes" should read --layers--.

Column 4, line 49 "extend" should read --extent--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*